US006109898A

United States Patent [19]

Scarlett

[11] Patent Number: 6,109,898

[45] Date of Patent: Aug. 29, 2000

[54] COMPRESSOR RING ATTACHMENT

[75] Inventor: Eric William Scarlett, South Lyon, Mich.

[73] Assignee: Ford Global Technologies, Inc., Dearborn, Mich.

[21] Appl. No.: 08/996,775

[22] Filed: Dec. 22, 1997

[51] Int. Cl.[7] ..... F01C 1/02

[52] U.S. Cl. ..... 418/55.3; 418/55.3; 418/55.1; 418/29; 29/888.022; 29/888.02; 29/434; 29/464; 464/41; 464/37; 464/139; 403/356; 403/355; 403/292; 403/294

[58] Field of Search ..... 418/29, 55.3, 55.1; 29/888.022, 434, 464, 888.02; 464/41, 37, 139; 403/356, 355, 292, 294

[56] References Cited

U.S. PATENT DOCUMENTS

| | | | |
|---|---|---|---|
| 589,236 | 8/1897 | Saeo | 418/55.3 |
| 4,340,339 | 7/1982 | Hiraga et al. | 418/55 |
| 4,432,708 | 2/1984 | Hiraga et al. | 418/55 |
| 4,544,136 | 10/1985 | Denman et al. | 464/77 |
| 4,548,556 | 10/1985 | Terauchi | 418/55 |
| 4,589,828 | 5/1986 | Sato et al. | 418/55 |
| 5,102,315 | 4/1992 | Terauchi et al. | 418/55.3 |

FOREIGN PATENT DOCUMENTS

| | | |
|---|---|---|
| 1-138388 | 5/1989 | Japan . |

*Primary Examiner*—Thomas Denion
*Assistant Examiner*—Theresa Trieu
*Attorney, Agent, or Firm*—Raymond L. Coppiellie

[57] ABSTRACT

A scroll compressor having a compressor housing and an orbiting scroll member is provided with an annular plate between the housing and orbiting scroll member. The plate having an axial aperture provided therethrough, the plate abutting one of said housing and said orbiting scroll member. A pin projects through the aperture of the plate and is engaged with the member abutting the plate. A projection is provided on the pin for preventing axial displacement of said pin relative to said plate axially away from the abutting member.

20 Claims, 2 Drawing Sheets

COMPRESSOR RING ATTACHMENT

FIELD OF INVENTION

The present invention relates to a method and apparatus for attaching an annular ring, particularly in a scroll-type compressor.

BACKGROUND OF THE INVENTION

In a scroll-type compressor of the prior art, as illustrated in FIGS. 1 and 2, a pin is provided to secure and locate a coupling ring to an adjacent part such as the scroll assembly or the compressor housing. In a typical prior art compressor, the pin comprises a roll pin or a solid pin which is press fit into both the coupling ring and the adjacent part. A through hole is provided in the coupling ring having a smaller diameter than the roll pin to form an interference fit. The adjacent part (the scroll or housing) has a similar undersize hole to form an interference fit with the roll pin.

In one prior art application, the pin is approximately 4 mm in diameter having approximately a 0.2 mm nominal interference fit to the hole provided in each of the components. Because of manufacturing tolerances, this interference fit may vary from 0 mm to 0.4 mm under normal conditions. However, excessive variation may result in a noninterference fit. Further, with larger interference fits, a large force is required for assembly. Typically, the coupling ring is made from steel and the pin is press-fit into the coupling ring. The coupling ring, having the pins installed, is then aligned to the adjacent part (either the scroll or housing, which may be made of aluminum), and the pin is then press-fit into the adjacent part. In the situation where a minimal interference fit is provided, the pin may become loose while the compressor is operating. In such an instance, the compressor may be damaged.

U.S. Pat. No. 4,340,339 discloses a second technique to rotationally engage a coupling ring to an adjoining component. Projections are provided on the coupling ring and radial slots are provided in the adjoining member. This technique is difficult and expensive to produce.

It would be desirable to provide a coupling ring assembly which is inexpensive and less sensitive to variation and which provides a secure retention of the pin.

SUMMARY OF THE INVENTION

In accordance with the objects of this invention, an air conditioning compressor is provided with an improved pin for attaching the coupling ring to an adjacent part. The pin provides a means for preventing the pin from becoming dislodged and damaging the compressor. The pin also accommodates the design which is less sensitive to variation in manufacturing.

DETAILED DESCRIPTION OF PREFERRED EMBODIMENTS

Figure 1:
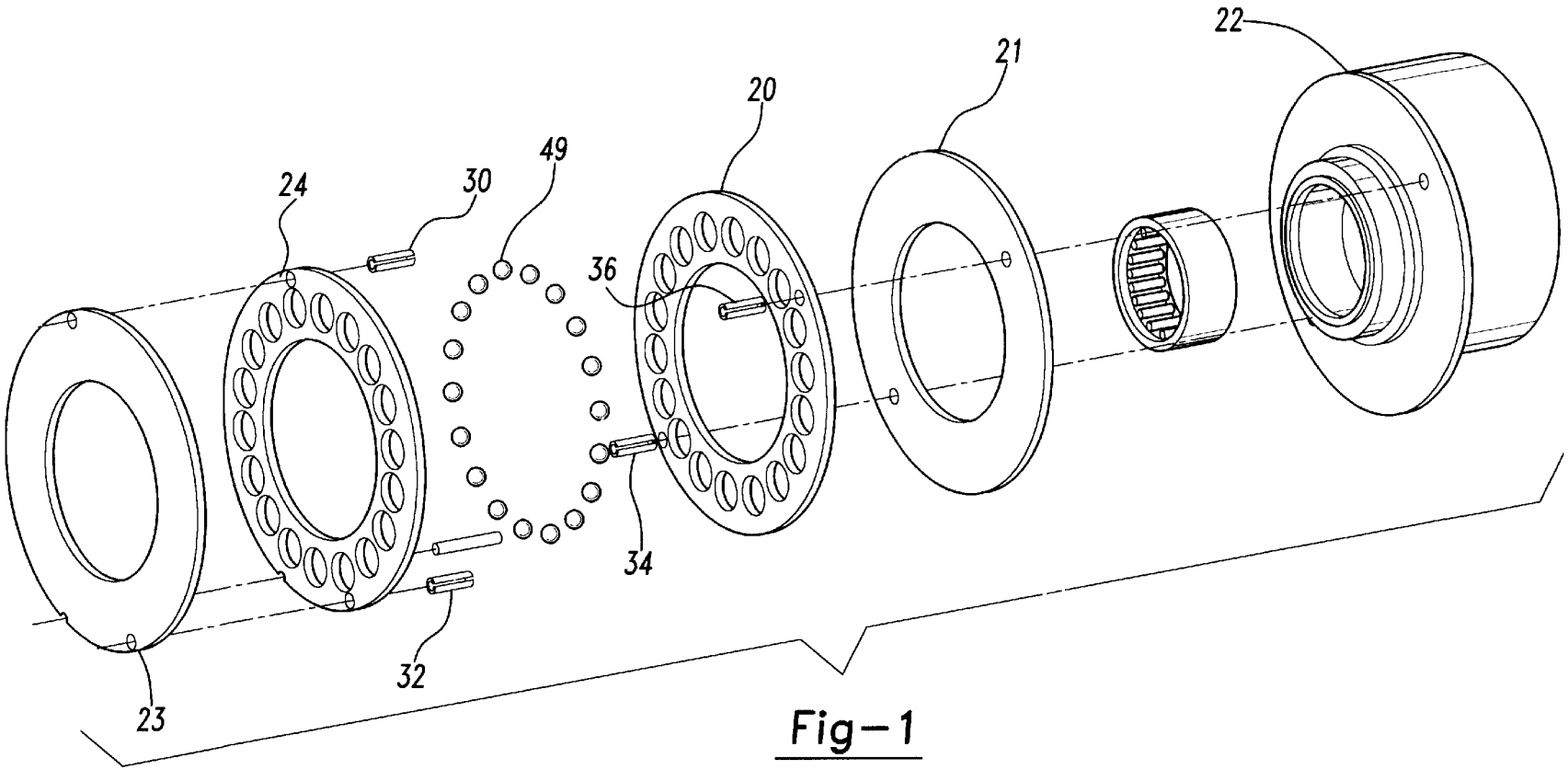
Fig—1 PRIOR ART
FIG. 1 is an exploded view of a coupling ring being assembled to an orbiting scroll of the prior art.
Figure 2:
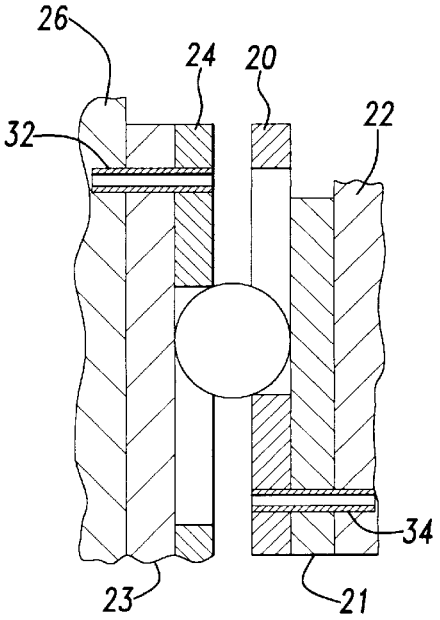
Fig-2 PRIOR ART
FIG. 2 is a partial sectional view through the assembly of FIG. 1 to illustrate a prior art attachment pin.

As shown in FIGS. 1–2, in scroll compressors of the prior art, a ball coupling ring 20 is provided adjacent an orbiting scroll assembly 22 and a second ball coupling ring 24 is provided adjacent a housing 26. These ball coupling rings 20, 24 are fixed to adjacent members 22, 26 using a press-fit pin 30, 32, 34, 36. As shown in prior art FIG. 2, a first plate 24 is fixed to the housing 26 using a pair of pins 30, 32. A second pair of pins 34, 36 hold a second plate 20 to the orbiting spiral assembly 22. The pins 30, 32, 34, 36 are press-fit into the plates 20, 24. The plate and pin assemblies are then press-fit into the housing 26 and scroll 22. As described in the Background section, during operation of the compressor, a prior art pin may work loose and damage the unit. A roll pin is frequently used in this application, or a solid cylindrical pin may likewise be used. These pins may hold other components, such as an intermediate member 21, 23. These members 21, 23 may comprise shims, wear plates, or other components.

The interference fit of the pins 30, 32, 34, 36 provides for alignment of the components as well as retention of the pins during operation under most conditions. Such an assembly is disclosed in U.S. Pat. No. 4,548,556, to Terauchi, which is incorporated herein by reference.

Applicant has recognized that the steel balls 49 exert an axially outward force on the coupling rings 20, 24. Therefore, applicant has recognized that the interference fit between the pins 30, 32, 34, 36 the rings 20, 24 is most beneficial for alignment and less necessary for axial retention of the plates 20, 24 to the adjacent part 22, 26.

Figure 3:
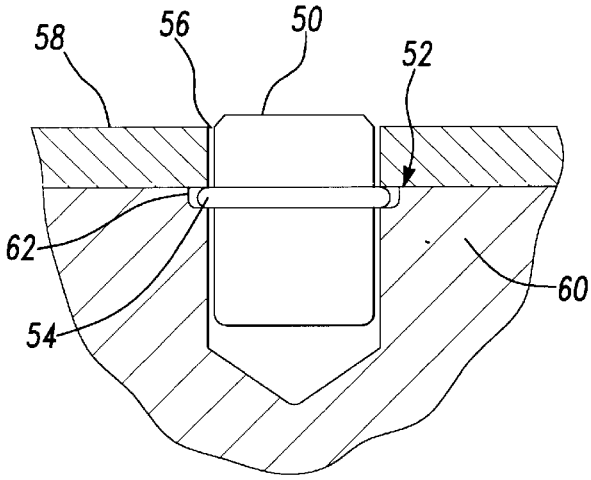
FIGS. 3–6 are partial views through attachment pins according to various embodiments of the present invention.

Applicant therefore propose an improved retention system of a coupling ring to an adjacent part. As illustrated in FIG. 3, this retention is accomplished by providing an axial retention means 52 including a pin 50 having an axial projection means 54 on the pin 50 to prevent axial movement of the pin 50 through a hole 56 provided in a coupling ring 58 away from an adjacent part 60. In the embodiment shown in FIG. 3, the projection means 54 comprises an annular projection protruding circumferentially about the pin 50. The annular projection is mated to a recess means 62, comprising a groove in the adjacent part 60.

Figure 4:
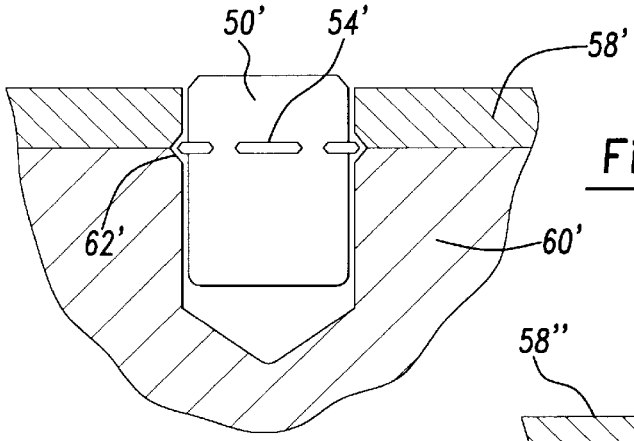

In an alternative embodiment, as illustrated in FIG. 4, the projection 54' comprises one or more nodular projections circumferentially spaced about the pin 50'. The groove 62 may be provided in the adjacent part 60 as shown in FIG. 3, or provided in both the adjacent part 60' and the coupling ring 58' as a pair of complimentary chamfers, as shown in FIG. 4.

Figure 5:
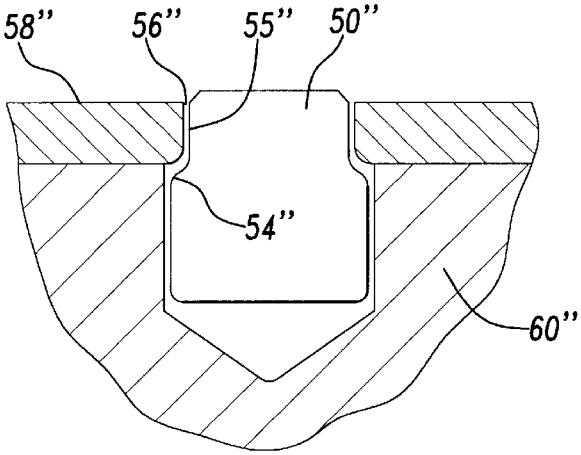

In a further alternative embodiment, as shown in FIG. 5, the projection means 54" comprises a shoulder provided on the pin 50". The pin 50" has a portion with a reduced diameter 55 which engages a hole 56" in the ring 58". The hole 58" in the ring 58" is smaller than the hole in the adjacent part 60" so the shoulder axially restrains the pin 50" against the ring 58". One skilled in the art recognizes many other alternative means of retaining the pin, including a snap ring, a cutter pin, or any other similar means which would provide a projection to axially retain the pin relative to the coupling ring. In a further alternative embodiment, the pin includes an annular groove provided therein and the annular projection shown in FIG. 3 is molded in the groove using a plastic material. In a further alternative embodiment, although not illustrated herein, a radial bore is provided in the pin and a retention pin is inserted therein to axially retain the pin against the ring.

In a preferred embodiment, the projection 54 is integrally formed with the pin 50, using a technique such as forging, rolling, casting, powdered metallurgy, welding, or any other known technique for forming a pin. One skilled in the art further recognizes that the pin could be made from any suitable material and the projection formed therein, such as forming the pin from a glass filled composite having adequate shear properties. One skilled in the art further recognizes the pin could have a circumferential groove formed therein and a snap ring or equivalent be used to axially retain the pin.

A further advantage of the present invention is that the current invention permits a smaller interference fit using the same hole manufacturing tolerances. In a preferred embodiment, the fit ranges from a zero interference, or line-to-line fit, to approximately a 0.2 mm interference fit (versus the prior art interference of 0.2 mm to 0.4 mm) for an approximately 6 mm pin. As a further cost reduction, the tolerances may be relaxed to allow a fit of 0 mm to 0.4 mm in an alternative embodiment, keeping the same maximum insertion forces as the prior art installation.

Figure 6:
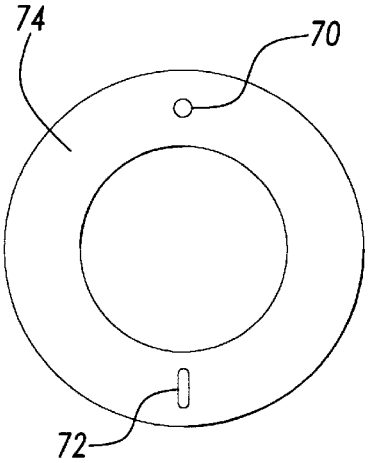

In a further alternative embodiment, a first hole 70 is provided in the coupling ring 74 in a manner similar to the holes of FIGS. 3–5. The first hole 70 is sized to fit the pin (not shown in FIG. 6) radially and circumferentially as described above with reference to FIGS. 3–5. A second hole 72 is provided in the coupling ring is slotted radially. Thus, a pin (not shown in FIG. 6) engages the first hole 70 to locate the coupling ring radially as well as circumferentially. A second pin (not shown in FIG. 6) engages the second hole 72 and only locates the plate 74 circumferentially. Therefore, any variation between the parts is more easily accommodated with lower assembly forces. The pins (not shown in FIG. 6) include a retention means (not shown) as described above.

It is to be understood that the embodiments of the invention described above are merely illustrative of application of principles of the present invention. Numerous modifications may be made to the methods and apparatus described above without departing from the true spirit and scope of the invention.

I claim:

1. A scroll compressor having a compressor housing and an orbiting scroll member, comprising:

an annular plate provided between the housing and orbiting scroll member, the plate having an axial aperture provided therethrough, the plate abutting one of said housing and said orbiting scroll member;

a pin projecting through the aperture of the plate and engaged with the member abutting the plate; and projection means provided on the pin for preventing axial displacement of said pin relative to said plate axially away from the abutting member.

2. A scroll compressor according to claim 1, wherein the projection means comprises a radial projection extending from the pin to abut the plate adjacent the axial aperture.

3. A scroll compressor according to claim 2, further comprising a recess means to axially accommodate the projection.

4. A scroll compressor according to claim 3, wherein the recess means comprises a counterbore in the abutting member.

5. A scroll compressor according to claim 3, wherein the recess means comprises a chamfer in one of the group comprising the annular plate and the abutting member.

6. A scroll compressor according to claim 3, wherein the recess means comprises a bore in the abutting member of greater diameter than the aperture in the annular plate.

7. A scroll compressor according to claim 6, wherein the radial projection comprises a shoulder provided on the pin.

8. A scroll compressor according to claim 2, wherein the projection means comprises an annular projection provided about the circumference of the pin.

9. A scroll compressor according to claim 2, wherein the projection means is integrally formed.

10. A scroll compressor according to claim 2, further comprising the plate having a second aperture formed therethrough for a second pin, the second aperture being radially slotted.

11. A method of attaching an annular ring in a scroll compressor having a compressor housing and an orbiting scroll member, the method comprising:

providing an axial aperture through the annular ring;

abutting the ring against one of said housing and said orbiting scroll member;

projecting a pin through the aperture of the plate and engaging the pin with the member abutting the ring; and providing a projection on the pin for preventing axial displacement of said pin relative to said plate axially away from the abutting member.

12. A method according to claim 11, further comprising inserting a first end of the pin into the ring until the projection engages the ring, then inserting a second end of the pin into the abutting member.

13. A method according to claim 11, further comprising the steps of:

locating the ring axially and radially relative to the abutting member with the first pin and aperture;

providing a second aperture through the ring, the second aperture being axially slotted; and locating the ring relative to the abutting member with a second pin and the second aperture.

14. A scroll compressor having a compressor housing and an orbiting scroll member, comprising:

an coupling ring provided between the housing and orbiting scroll member, the ring having an axial aperture provided therethrough, the ring abutting one of said housing and said orbiting scroll member;

a pin projecting through the aperture of the ring having a press fit with the ring and the member abutting the ring; and projection means provided on the pin for preventing axial displacement of said pin relative to said ring axially away from the abutting member.

15. A scroll compressor according to claim 14, wherein the projection means comprises a plurality of circumferentially spaced radial projections extending from the pin to abut the plate adjacent the axial aperture.

16. A scroll compressor according to claim 15, further comprising a recess means provided in the abutting member to axially accommodate the projections.

17. A scroll compressor according to claim 14, wherein the projection means comprises a bore in the abutting member of greater diameter than the aperture in the annular plate and said pin having a shoulder provided thereupon installed within the bore of the abutting member.

18. A scroll compressor according to claim 14, wherein the projection means comprises an annular projection provided about the circumference of the pin.

19. A scroll compressor according to claim 18, wherein the projection means is integrally formed.

20. A scroll compressor according to claim 14, further comprising the ring having a second aperture formed therethrough for a second pin, the second aperture being radially slotted.

* * * * *